US006790813B2

(12) United States Patent
Boffa

(10) Patent No.: US 6,790,813 B2
(45) Date of Patent: Sep. 14, 2004

(54) OIL COMPOSITIONS FOR IMPROVED FUEL ECONOMY

(75) Inventor: Alexander B. Boffa, Richmond, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 10/301,374

(22) Filed: Nov. 21, 2002

(65) Prior Publication Data

US 2004/0102336 A1 May 27, 2004

(51) Int. Cl.[7] ..... C10M 141/08; C10M 159/24

(52) U.S. Cl. ..... 508/198; 508/199; 508/221; 508/287; 508/372; 508/373; 508/391; 508/408; 508/410

(58) Field of Search ..... 508/199, 408, 508/410, 198, 190

(56) References Cited

U.S. PATENT DOCUMENTS

| | | | | |
|---|---|---|---|---|
| 4,137,184 | A | 1/1979 | Bakker | |
| 4,746,446 | A | 5/1988 | Wollenberg et al. | |
| 4,995,993 | A | 2/1991 | Papke et al. | |
| 4,997,584 | A | 3/1991 | Jao et al. | |
| 5,011,618 | A | 4/1991 | Papke et al. | |
| 5,108,630 | A | 4/1992 | Black et al. | |
| 5,332,514 | A | 7/1994 | Kreuz et al. | |
| 5,578,235 | A | 11/1996 | Jao et al. | |
| 5,629,272 | A | 5/1997 | Nakazato et al. | |
| 5,759,966 | A | 6/1998 | Campbell | |
| 5,792,732 | A | 8/1998 | Jao et al. | |
| 6,015,778 | A | 1/2000 | Rolfes et al. | |
| 6,054,419 | A | 4/2000 | Le Coent | |
| 6,107,259 | A | 8/2000 | Muir et al. | |
| 6,239,083 | B1 | 5/2001 | Muir | |
| 6,294,506 | B1 * | 9/2001 | Friesen et al. | 508/287 |
| 6,300,291 | B1 | 10/2001 | Hartley et al. | |
| 6,310,010 | B1 * | 10/2001 | Higton et al. | 508/192 |
| 6,337,310 | B1 | 1/2002 | Campbell et al. | |
| 6,417,148 | B1 | 7/2002 | Skinner et al. | |
| 6,423,670 | B2 * | 7/2002 | Locke et al. | 508/192 |
| 6,479,440 | B1 * | 11/2002 | Le Coent | 508/398 |
| 6,551,967 | B2 * | 4/2003 | King et al. | 508/391 |
| 6,569,819 | B2 * | 5/2003 | Yagishita et al. | 508/291 |
| 6,617,287 | B2 * | 9/2003 | Gahagan et al. | 508/192 |

FOREIGN PATENT DOCUMENTS

| | | |
|---|---|---|
| EP | 0 725 129 A2 | 6/1996 |
| EP | 1 059 301 A1 | 12/2000 |
| EP | 0 757 711 B2 | 5/2002 |
| GB | 2 102 023 A | 1/1983 |
| WO | WO 93/21289 | 10/1993 |
| WO | WO 00/77015 A1 | 12/2000 |

OTHER PUBLICATIONS

Inoue et al. Interactions of Engine Additives. ASLE Transactions. 37th Annual Meting. Cincinnati. OH. May 10–13. 1982. vol. 26. 2. pp. 189–199.

(List continued on next page.)

*Primary Examiner*—Ellen M. McAvoy
(74) *Attorney, Agent, or Firm*—Joseph P. Foley; Claude J. Caroli

(57) ABSTRACT

Oil compositions and formulated crankcase engine oils demonstrate improved fuel economy performance when comprising an overbased sulfonate detergent having a total base number greater than about 450 and which contain at least one other additive which includes a succinimide type dispersant. Methods for improving fuel economy employing such high TBN sulfonates and engine oil formulations and concentrates containing such are disclosed.

27 Claims, 1 Drawing Sheet

OTHER PUBLICATIONS

Glasson et al., Study of Microstructural Transformation of Overbased Calcium Sulphonates During Friction. Lubrication Science 5–2. Jan. 1993 (5) pp. 91–111. Leaf Coppin Publishing Ltd.

A B Vipper et al . Antifriction Action of Lubricant Additives. Lubrication Science 7–3, Apr. 1995 (7) pp. 247–259. Leaf Coppin Publishing Ltd.

Tseregounis et al., Engine Oil Effects on Fuel Economy in GM Vehicles—Separation of Viscosity and Friction Modifier Effects. Inetrnational Fall Fuels and Lubricants Meeting and Exposition. San Francisco. CA. Oct. 19–22. 1998. SAE Technical Paper Series 982502. pp. 1–11.

Hoshino et al. Fuel Efficiency of SAE 5W–20 Friction Modified Gasoline Engine Oil. International Fall Fuels and Lubricants Meeting and Exposition, San Francisco. CA. Oct. 19–22, 1998. SAE Technical Paper Series 982506, pp. 1–6.

Cockbill et al., The Effects of Crankcase Oil Viscosity on Engine Friction at Low Temperatures. *International Spring Fuels and Lubricants Meeting and Exposition*. Paris. France. Jun. 19–22, 2000. SAE Technical Paper Series 2000–01–02052, pp. 1–7.

Tseregounis et al., Fuel Economy Gains with Modern Technology. SAE 5W–20 Engine Oils in a GM Engine as Measured in the EPA FTP Test, International Spring Fuels and Lubricants Meeting and Exposition, Orlando, FL. May 7–9, 2001. SAE Technical Paper Series 2001–01–1900.

Boffa et al., Oil Impacts on Sequence VIB Fuel Economy, International Spring Fuels and Lubricants Meeting and Exposition, Orlando, FL. May 7–9, 2001. SAE Technical Paper Series 2001–01–1903.

O'Conner et al., Overbased Lubricant Detergents—a Comparative Study. Lubrication Science 6–4, Jul. 1994 (6) pp. 297–325, Leaf Coppin Publishing Ltd.

* cited by examiner

OIL COMPOSITIONS FOR IMPROVED FUEL ECONOMY

FIELD OF THE INVENTION

The present invention relates to lubricating oil compositions which demonstrate improved fuel economy. These fuel economizing lubricants employ an overbased sulfonate detergent having a total base number greater than about 450 and at least one other additive which includes a succinimide type dispersant.

BACKGROUND OF THE INVENTION

While motor vehicle manufacturers continue to seek improved fuel economy through engine design; new approaches in formulating engine oils have played an important role in improving fuel economy and have resulted in improved emission characteristics of motor vehicles. Lubricant optimization is especially preferred over engine hardware changes, due to its comparative lower cost per unit in fuel efficiency and possibility for backward compatibility with older engines. Therefore, formulators are under continued pressure to develop engine oils and additive packages which take advantage of new performance basestocks and additive blends which demonstrate better fuel efficiency, oxidative stability, volatility, and improved viscosity index (to name a few characteristics) over conventional formulations. To improve fuel efficiency, there has been a drive to use lower viscosity engine oils, which often requires new additive package formulations. High on the list of requirements for these new formulated engine oil specifications are those employing components which improve the frictional properties of the lubricating oil composition. In this case, the additive system design is the crucial factor and close attention must be focused on the additive/additive and additive/base fluid interactions.

Engine oil acts as a lubricant between moving engine parts at various conditions of load, speed and temperature. Hence, the various engine components experience different combinations of boundary layer, mixed and (elasto) hydrodynamic regimes of lubrication; with the largest frictional losses at piston liner/piston ring interface and a smaller part by the bearing and valve train. To reduce the energy losses due to friction of the various parts and to prevent engine wear, additives are incorporated into the engine oil such as friction modifiers, anti-wear agents, and antioxidants; the latter of which tend to lengthen the effect of the afore mentioned additives. Also to reduce the hydrodynamic friction in the piston/cylinder, the viscosity of engine oils has been lowered which has increased the dependence of friction modifiers to offset the new boundary layer regime. Hence, a vast amount of effort has focused on the interaction of oil viscosity with various friction modifiers to improve fuel economy.

Friction modifiers have been around for several years for application in limited slip gear oils, automatic transmission fluids, slideway lubricants and multipurpose tractor fluids. With the desire for increased fuel economy, friction modifiers have been added to automotive crankcase lubricants and several are known in the art. They generally operate at boundary layer conditions at temperatures where anti-wear and extreme pressure additives are not yet reactive by forming a thin mono-molecular layers of physically adsorbed polar oil-soluble products or reaction layers which exhibit a significantly lower friction compared to typical anti-wear or extreme pressure agents. However, under more severe conditions and in mixed lubrication regime these friction modifiers are added with an anti-wear or extreme pressure agent. The most common type is a zinc dithiophosphate (ZnDTP or ZDDP), which, due to emissions considerations, has been reduced in concentration in many current formulations.

Anti-wear, extreme pressure, anti-corrosion, and friction modifiers; as well as detergents and dispersants, are all polar additives which have an affinity to metal surfaces and can compete for the active metal surface site, or interact with each other. For example, anti-wear agents such as ZnDTP and ZnDTC protect closely approaching metal surfaces from asperities from damaging the opposite surface. These films are semi-plastic and are difficult to shear off, so that under shearing conditions, their coefficient of friction is generally high. Conversely, a friction modifier generally operates by building an orderly and closely packed arrays of multi-molecule layers which are attracted to the metal surface via their polar heads and aligned to each other via Van der Waal forces. Therefore, when surface active agents such as anti-wear agents ZnDTP, a friction modifier, dispersant or detergent are added to a lubricating oil, the adsorption of the anti-wear agent is reduced by the competitive adsorption of the other agents. The resulting protective film formation can be retarded or eliminated; thus, decreasing the overall available power and engine efficiency.

Dispersants and detergents are widely known in the art, and are generally employed to keep sludge, carbon and other deposit precursors derived from partial oxidation of the fuel or lubricating oils suspended in the oil. In addition, detergents function to neutralize potentially corrosive acids and to contribute to cleanliness. For engine oils this is primarily to neutralize acidic by products of combustion, oxidation or decomposition and thereby reduce the amount of corrosive wear and also to keep the pistons and other high temperature surfaces clean of deposits. However, as stated above, dispersants and detergents are generally polar molecules which can adversely interact with other functional additives. For example, overbased sulfonates are also known to act as a pro-oxidant and degrade antioxidant performance. Outside of their contribution to viscosity of the final lubricating composition, the degree of overbasing of a detergent was not thought to have any effect related to fuel economy.

Accordingly, the selection of components and interactions between them is of major concern and beneficial interactions or new properties and improvements resulting therefrom, are not expected or possible to anticipate. Thus when discovered, especially when additives are used which exhibit a dual benefit not appreciated in the art, clearly advances the art. While significant improvements in fuel economy have been achieved since 1987 (with EC-I, GF-1, GF-2 and GF-3 compliant lubricants) proposed GF-4 oils and future standards will prove further developments are necessary and paradigm shifts to additive formulations are needed. In the present invention, a surprisingly significant effect on fuel economy has been attributed to detergent/dispersant selection.

SUMMARY OF THE INVENTION

The present invention provides a lubricating composition comprising a major amount of an oil of lubricating viscosity, an oil soluble overbased alkaline earth alkyl aryl sulfonate detergent having a total base number (TBN) of about 450 to 550, and an alkenyl succinimide dispersant derived from a 450 to 3000 average molecular weight polyalkylene. Formulated lubricating oil employing such high TBN overbased sulfonates have shown improved properties, especially in fuel economy when compared to conventional overbased metal detergents. Accordingly the use of such lubricants can be applied in engine oil formulations, crankcase formulations, and gear oil formulations for improving fuel economy.

Accordingly, one embodiment is directed to a formulated lubricating composition. One such formulation for internal combustion engines comprises: (a) a major amount of a base oil of lubricating viscosity; (b) 0.5% to 10% of an overbased alkaline earth metal, preferably calcium, alkyl aryl sulfonate detergent having a total base number (TBN) of about 450 to 550; (c) 1% to 20% of an alkenyl succinimide dispersant, preferably a carbonate treated alkenyl succinimide, derived from a 450 to 3000 average molecular weight polyalkylene; (d) 0.05% to 1.0% of a friction modifier; and (e) 0.1% to 2.0% of a zinc dialkyldithiophosphate; wherein the percent additive is based upon weight percent of the lubricating oil composition.

In another aspect, this invention is directed to a concentrate comprising from about 10% to 80% of an overbased alkaline earth metal, preferably calcium, alkyl aryl sulfonate detergent having a total base number (TBN) of about 450 to 550 and from about 20% to 60% of an alkenyl succinimide dispersant, preferably a carbonate treated alkenyl succinimide, derived from a 450 to 3000 average molecular weight polyalkylene and about 1% to 10% of a compatible organic liquid diluent.

Lubricating oil compositions employing an overbased sulfonate detergent having a total base number greater than about 450 and at least one other additive which includes a succinimide type dispersant have shown improved fuel economy over conventional detergents. Accordingly, this invention is directed to a method for improving fuel economy of an internal combustion engine, preferably gasoline, comprising operating said engine with a lubricating composition comprising a major amount of an oil of lubricating viscosity and a fuel economizing amount of an oil soluble overbased alkaline earth alkyl aryl sulfonate detergent having a TBN greater than 450 and a alkenyl succinimide dispersant derived from a 450 to 3000 average molecular weight polyalkylene. One such method for determining fuel economy can be measured by the Sequence VIB test using a reference oil.

Among other factors, the present invention is based upon the surprising discovery that high overbased (greater than 450 TBN) alkyl aryl sulfonate detergents provide an improvement in fuel economy over lower overbased alkyl aryl sulfonate detergents, and in comparison with other conventional detergent chemistries. More specifically, lubricating compositions and formulated engine oils employing a polyalkylene succinimide dispersant and a sulfonate detergent having a TBN greater than about 450 have been shown to improve fuel economy. Therefore, employing such a lubricating composition in an engine oil application, gear oil application or other application requiring lubrication, can lead to an improvement in overall fuel economy.

DETAILED DESCRIPTION OF THE INVENTION

Figure 1:
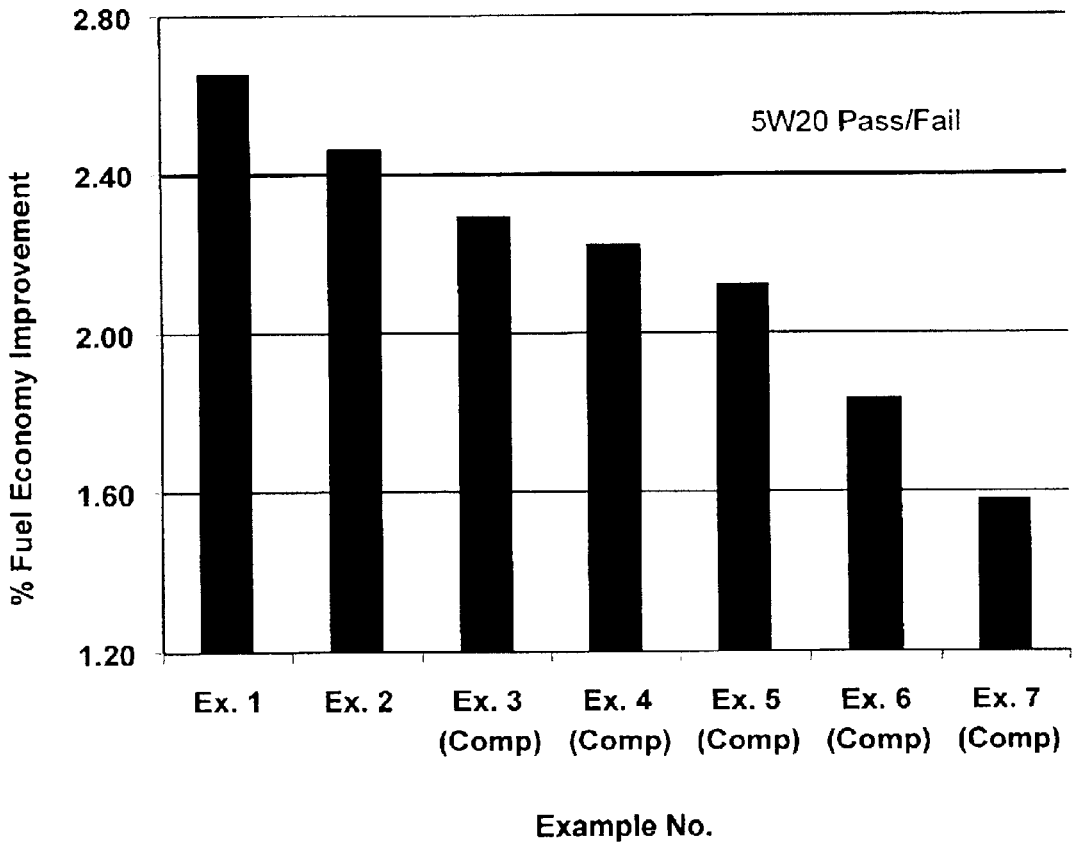
FIG. 1 is a graph of fuel economy improvement in regard to various ash type detergents.

A problem associated with conventional internal combustion engine systems is contamination of the lubricating oil with combustion products. This is more pronounced with engines equipped with exhaust gas after treatment devices (e.g., catalytic converters, particulate traps, catalyzed traps, etc.) in that the lubricating oils for such engines are used in both the crankcase as well as in high wear areas such as the valve train. During engine operation, additives in the oil can decompose and enter the after treatment device; this has been previously identified with phosphorous poisoning of the catalyst and zinc dithiophosphate used as an extreme pressure additive. Moreover, blow-by exhaust gases generated in the crankcase typically come in contact with the valve train and are more often being recirculated to the combustion chamber which leads to greater soot formation, increased acid gases, increased oxidation; thereby placing greater constraints on the additive package. However, even in light of this more extreme service, additive combinations are increasing being relied upon to lengthen service life of the lubricant and moreover to improve fuel economy performance.

Research into fuel saving internal combustion engine lubricating oil has intensified and has often focused by employing friction modifiers. While these friction modifiers often are effective initially in fresh lubricating oils, they quickly loose effect due to degradation during engine operation. For example, molybdenum compounds such as molybdenum dithiocarbamate have been shown to improve fuel economy but also to be susceptible to degradation due to aging. Friction modifier degradation is even more pronounced at low zinc dithiophosphate level since this compound tends to serve as an antioxidant. Thus, new approaches to improve fuel economy not derived solely from viscosity or conventional friction modifiers needs to be developed. Accordingly, engine oil formulations having fuel economy benefits as well as methods and the use of high TBN sulfonates which exhibit improved fuel economy are described below.

The Detergent

Metal detergents have widely been employed in engine oil lubricating formulations to neutralize the acidic by-products of the combustion process and/or lubricant oxidation and to provide a soap effect and keep pistons and other high temperature surfaces clean thus preventing sludge. A number of different surfactant types have been used to produce different lubricant detergents. Common examples of metal detergents included: sulphonates, alkylphenates, sulfurized alkyl phenates, carboxylates, salicylates, phosponates, and phosphinates. Commercial products are generally referred to as neutral or overbased. Overbased metal sulfonates are generally produced by carbonating a mixture of hydrocarbons, sulfonic acid, metal oxide or hydroxides (for example calcium oxide or calcium hydroxide) and promoters such as xylene, methanol and water. For example for preparing an overbased calcium sulfonate; in carbonation, the calcium oxide or hydroxide reacts with the gaseous carbon dioxide to form calcium carbonate. The sulfonic acid is neutralized with an excess of CaO or Ca(OH), to form the sulfonate. The prior art known processes for overbasing calcium sulfonates generally produces high alkaline reserves of TBN of 300 to 400 mg KOH/gm or higher. Commercially available high TBN, up to approximately 400 TBN sulphonates, have enabled the formulator to use lower amounts of acid neutralizing additive while maintaining equivalent detergency, thus protecting the engine adequately under conditions of high acid formation in the combustion process. However, difficulties in manufacturing higher TBN sulfonates, related to unacceptable resulting water tolerance, poor compatibility, and high detergent viscosities; without any additional known benefit, has stopped formulators from experimenting and/or developing lubricating compositions employing these high TBN detergents. This invention discloses that employing extremely high TBN sulfonates (greater that 450 TBN) with an succinimide dispersant, for example, in an automobile crankcase engine oil formulation can lead to improvements in fuel economy.

The greater than 450 TBN sulfonate detergent is preferably an alkaline earth metal salt of a hydrocarbyl sulfonic acid having from 8 to 200 carbons. Preferably the term "sulfonate" encompasses the salts of sulfonic acid derived from petroleum products. Such acids are well known in the art. They can be obtained by treating petroleum products with sulfuric acid or sulfur trioxide. The acids thus obtained are known as petroleum sulfonic acids and the salts as petroleum sulfonates or as natural sulfonates. Most of the petroleum products which become sulfonated contain an oil-solubilizing hydrocarbon group and may be used in this invention.

Also included within the meaning of "sulfonate" are the salts of sulfonic acids of synthetic alkyl aryl compounds, which often are preferred. These acids also are prepared by treating an alkyl aryl compound with sulfuric acid or sulfur trioxide. At least one alkyl substituent of the aryl ring is an oil-solubilizing group, as discussed above. The acids thus obtained are known as synthetic alkyl aryl sulfonic acids and the salts as alkyl aryl sulfonates. The sulfonates where the alkyl is straight-chain are the well-known linear alkylaryl sulfonates. Typically these obtained by the oliopolymerization of ethylene to $C_{14}$ to $C_{40}$ hydrocarbons followed by alkylation via a Friedel and Craft reaction of an aryl hydrocarbon. Branched olefins can be obtained from the oligo-polymerization of for example, propylene to $C_{15}$ to $C_{42}$ hydrocarbons and particularly the propylene tetrapolymer dimerized to a $C_{24}$ olefin, or alkylation of aromatics using normal alpha olefins. Preferred aryl groups are phenyl and substituted phenyl, preferably tolyl, xylyl, particularly ortho xylyl, ethyl phenyl, cumenyl and the like.

The acids obtained by sulfonation are converted to the metal salts by neutralizing with a basic reacting alkali or alkaline earth metal compound to yield the Group I or Group II metal sulfonates. Generally, the acids are neutralized with an alkali metal base. Alkaline earth metal salts are obtained from the alkali metal salt by metathesis. Alternatively, the sulfonic acids can be neutralized directly with an alkaline earth metal base. The sulfonates are then be overbased and such overbased materials and methods of preparing such materials are known to those skilled in the art. See, for example, LeSuer U.S. Pat. No. 3,496,105, issued Feb. 17, 1970, particularly Cols. 3 and 4.

The sulfonates are present in the lubricating oil composition in the form of alkaline earth metal salts, or mixtures thereof. The alkaline earth metals include magnesium, calcium and barium, of which calcium is preferred. The sulfonates are superalkalinized employing excess alkaline metal base carbon dioxide or other suitable base source. Often this is added sequentially or step wise addition with or without a promoter, paying particular attention to the overbasing process since improper overbasing will lead to highly viscous sulfonates or lower overbased than desired. The oil soluble overbased alkaline earth alkyl aryl sulfonate detergents are overbased under suitable conditions to substantially produce about a 450 to 550 TBN detergent, preferably a TBN greater than 475 TBN and more preferably from about 480 to 500 TBN. TBN can be measured according to ASTM D2896. Particularly preferred for overbasing are calcium oxide and/or calcium hydroxide with carbon dioxide to produce an overbased calcium sulfonate. Moreover, at these preferred TBN ranges it is preferred that the sulfonate detergent have a kinematic viscosity at 100° C. of less than 500 cSt, preferably less than 350 cSt, preferably less than 250 cSt and more preferably less than 200 cSt and even more preferably less than 180 cSt.

Particularly preferred, however, because of their wide availability, are salts of the petroleum sulfonic acids, particularly the petroleum sulfonic acids which are obtained by sulfonating various hydrocarbon fractions such as lubricating oil fractions and extracts rich in aromatics which are obtained by extracting a hydrocarbon oil with a selective solvent, which extracts may, if desired, be alkylated before sulfonation by reacting them with olefins or alkyl chlorides by means of an alkylation catalyst; organic polysulfonic acids such as benzene disulfonic acid which may or may not be alkylated; and the like.

The preferred salts for use in the present invention are those of alkylated aromatic sulfonic acids in which the alkyl radical or radicals contain at least about 8 carbon atoms, for example from about 8 to 40 carbon atoms. Another preferred group of sulfonate starting materials are the aliphatic-substituted cyclic sulfonic acids in which the aliphatic substituents or substituents contain a total of at least 12 carbon atoms, such as the alkyl aryl sulfonic acids, alkyl cycloaliphatic sulfonic acids, the alkyl heterocyclic sulfonic acids and aliphatic sulfonic acids in which the aliphatic radical or radicals contain a total of at least 12 carbon atoms. Specific examples of these oil-soluble sulfonic acids include petroleum sulfonic acid, petrolatum sulfonic acids, mono- and poly-wax-substituted naphthalene sulfonic acids, substituted sulfonic acids, such as cetyl benzene sulfonic acids, cetyl phenyl sulfonic acids, and the like, aliphatic sulfonic acid, such as paraffin wax sulfonic acids, hydroxy-substituted paraffin wax sulfonic acids, etc., cycloaliphatic sulfonic acids, petroleum naphthalene sulfonic acids, cetyl cyclopentyl sulfonic acid, mono- and poly-wax-substituted cyclohexyl sulfonic acids, and the like. The term "petroleum sulfonic acids" is intended to cover all natural sulfonic acids that are derived directly from petroleum products. Typical Group II metal sulfonates suitable for use in this composition include the metal sulfonates exemplified as follows: calcium white oil benzene sulfonate, barium white oil benzene sulfonate, magnesium white oil benzene sulfonate, calcium dipolypropene benzene sulfonate, barium dipolypropene benzene sulfonate, magnesium dipolypropene benzene sulfonate, calcium mahogany petroleum sulfonate, barium mahogany petroleum sulfonate, magnesium mahogany petroleum sulfonate, calcium triacontyl sulfonate, magnesium triacontyl sulfonate, calcium lauryl sulfonate, barium lauryl sulfonate, magnesium lauryl sulfonate, etc.

Also preferred are synthetic alkylaryl sulfonates. Particularly useful are synthetic alkylaryl sulfonates having the aryl sulfonate attached at the 1 or 2 position of the alkyl group, preferably greater than 5 mole %, more preferably greater than 13 mole % and more preferably greater than 20 mole %, as these have shown good compatibility and solubility while not forming a skin at these levels of overbasing. Preferred are linear monoalkyl sulfonates. Preferably the alkyl chain contains between 14 and 40 carbons and more preferably the alkylaryl sulfonate is derived from a $C_{14}$–$C_{40}$ normal alpha olefin and more particularly from a $C_{20}$–$C_{28}$ or a $C_{20}$–$C_{24}$ normal alpha olefin.

Mixtures of high TBN sulfonates can be employed including mixtures of natural sulfonates and synthetic sulfonates, mixtures of synthetic sulfonates such as mixtures of monoalkyl and dialkyl sulfonates, mixtures of monoalkyl and polyalkyl sulfonates or mixtures of dialkyl and polyalkyl sulfonates.

Preferably the overbased alkaline earth metal alkyl aryl sulfonate detergent comprises from 0.5 to 10 weight percent and preferably 0.8 to 5 weight percent of the lubricating oil composition.

EXAMPLE A -Preparation of a 500 TBN alkarylsulfonate with 29 mole % 1 or 2 alkyl attachment to the aryl group: This product was produced in a continuous reactor formed by the reaction of benzene and a $C_{20}$ to $C_{24}$ linear olefin derived from a normal alpha olefin in the presence of hydrogen fluoride. The alkylate is distilled and sulfonation is conducted in a concurrent stream using sulfur trioxide ($SO_3$), produced by the passage of a mixture of oxygen and sulfur dioxide through a catalytic furnace containing vanadium oxide. The sulfonation reaction is conducted at a temperature between 50–60° C., a sulfur trioxide flow rate of 76 grams/hour a $SO_3$:alkylate mole ratio of 0.8:1 to 1.2:1 with nitrogen used as a vector gas to dilute the $SO_3$ to 4% by volume. Residual sulfuric acid is removed by thermal treatment after dilution by 10% 100 N oil and nitrogen bubbling. This product is overbased by addition of excess hydrated lime in a xylene and methanol carrier and carbonation by addition of carbon dioxide at a temperature of 20–55° C. Optionally water is introduced at 79° C. during the elimination of methanol/water and prior to centrifugation. Procedures for making high overbased 1 or 2 alkyl attached alkyl aryl sulfonates are disclosed in PCT Publication No. WO 00/77015 incorporated herein by reference. The resulting product is characterized as a 502 TBN (ASTM D2896) alkyl benzene sulfonate having a % Ca total of 18.8, a viscosity at 100° C. of 172 cSt.

EXAMPLE A1-Preparation of a 500 TBN alkarylsulfonate with 29 mole % 1 or 2 alkyl attachment to the aryl group: The same procedure is conducted as in Example 1, however upon overbasing there is no subsequent addition of water during the elimination of methanol/water and prior to centrifugation.

EXAMPLE B Preparation of a 500 TBN alkyl benzene sulfonate: 19.71 grams of linear monoalkyl (nominally $C_{18-20}$ alkyl) benzene sulfonic acid (having 87% acid) in oil is added to a 1-liter, 4-neck reaction flask. Such acids are commercially available as MixOil 1245 from MixOil S.P.A. To this, 17.0 grams 100P pale oil, 52.66 grams of a linear dialkyl (nominally dodecyl) benzene sulfonate, commercially available as Petronate C-50N from Witco Corp., 182.0 grams n-heptane, 18.96 grams methanol and 2.40 grams calcium hydroxide is added to the flask. The mixture is heated at 50° C. for one hour while stirring. The mixture is then overbased by adding 42.64 grams CaO and 37.56 grams $Ca(OH)_2$ and raising the reaction temperature to 60° C. 3.6 ml of water is added immediately before carbonation. Carbonation is carried out by bubbling $CO_2$ through the mixture at 188 ml/min for 135 minutes. The crude product is filtered and 15 grams 100P pale oil is added to 200 ml of crude product before stripping the solvent. The TBN of the linear alkylbenzene sulfonate is 507 TBN.

EXAMPLE C Preparation of a 500 TBN synthetic and natural sulfonate: A blend containing 18.67 parts by weight dialkyl benzene sulfonate (synthetic calcium sulfonate), 6.9 parts petroleum sulfonate, 91 parts heptane, 8 parts methanol, 0.1 part calcium chloride, 10.82 parts calcium oxide, and 9.53 parts calcium hydroxide is brought to reflux (60° C.) in a 500 ml 4-neck reaction flask and is reacted for 10 minutes. Water is added 0.9 parts immediately before carbonization. $CO_2$ is introduced at a rate of 40 ml/min and is stopped after 135 minutes. The product is filtered and 4.3 parts of a low molecular weight pale oil is added. The synthetic and natural sulfonate is characterized by a TBN of 505, a kinematic viscosity at 100° C. of 334 cSt, with 18% total calcium and containing 19.3% calcium sulfonate.

EXAMPLE D Preparation of a 500+TBN synthetic mono/dialkyl sulfonate: A blend is formed containing 7.55 gram of synthetic monoalkylbenzene sulfonic acid ($C_{16-26}$ alkyl which can be obtained from Enimont as MAPS), 15.44 gram synthetic dialkylbenzene sulfonate ($C_{10-18}$ alkyl), 5.89 gram pale oil, 91.0 gram n-heptane, 7.9 gram methanol, and 0.086 gram calcium chloride. The mixture is heated to reflux in a 500 ml (milliliter) reaction flask for 15 minutes. The mixture is neutralized by addition of 0.88 gram calcium hydroxide which is allowed to mix for 30 minutes at 50° C. After neutralization, the mixture is overbased by the addition of 12.79 gram calcium oxide and 11.27 gram calcium hydroxide, and the reaction temperature is increased to 60° C. At this point, 1.10 ml water is added, and carbon dioxide is immediately introduced, at a rate of 40 ml/minute, for 135 minutes. The product is filtered and solvent-stripped. The resulting synthetic mono/dialkyl sulfonate is characterized by a TBN value of 509/513.

EXAMPLE E: Preparation of a 500+TBN mixed synthetic sulfonate: A blend is formed containing 45.30 gram of synthetic monoalkylbenzene sulfonic acid ($C_{16-26}$ alkyl obtained from Enimont as MAPS), 92.64 gram synthetic dialkylbenzene sulfonate ($C_{10-18}$ alkyl), 35.34 gram pale oil, 798.00 ml n-heptane, 47.40 gram methanol, and 0.516 gram calcium chloride. The mixture is heated to reflux in a 3 liter reaction flask for 15 minutes. The mixture is neutralized by the addition of 5.28 gram calcium hydroxide which is allowed to mix for 30 minutes at 50° C. After neutralization the mixture is overbased by the addition of 76.74 gram calcium oxide and 67.62 gram calcium hydroxide, and the reaction temperature is raised to 60° C. At this point, 6.6 ml water was added, and carbon dioxide is immediately introduced at a rate of 250 ml/minute for 135 minutes. The product is filtered and solvent stripped. The resulting synthetic sulfonate is characterized by a TBN value of 528 and 20.9% calcium.

EXAMPLE F: Preparation of a 500+TBN mixed synthetic sulfonate: A blend is formed containing 3.1 lbs of synthetic monoalkylbenzene sulfonic acid ($C_{16-26}$ alkyl obtained from Enimont as MAPS), 8.7 lbs synthetic dialkylbenzene sulfonate, ($C_{10-18}$ alkyl) 38 lbs heptane, 2.2 lbs 100 P pale oil, 5.6 lbs methyl alcohol, and 0.56 lb calcium hydroxide. This mixture is brought to reflux (57° C.) in a 10-gallon reactor and is refluxed and stirred at 55–60° C. for one hour to allow for neutralization of the sulfonic acid. After neutralization, the reaction mixture is cooled to 40° C. The mixture is overbased by the addition of 6.4 lbs calcium oxide, 5.6 lbs calcium hydroxide, 25 grams calcium chloride and 0.5 lb water. The temperature of the reaction mixture is raised to 60° C. and carbon dioxide is added for a total of 6.6 lbs $CO_2$ which is added at a constant rate over a period of 3 hours. The resulting crude product is filtered at 40° C. and then is stripped the solvents at 120° C. The stripped filtrate is characterized by as having a TBN of 575 TBN to which an appropriate amount of 100 P pale oil is added to obtain the resulting synthetic sulfonate which is characterized by a TBN value of 500 and a kinematic viscosity of 82 cSt at 100° C.

The Dispersant

The dispersant employed in the compositions of this invention can be ashless dispersants such as an alkenyl succinimide, an alkenyl succinic anhydride, an alkenyl succinate ester, and the like, or mixtures of such dispersants.

Ashless dispersants are broadly divided into several groups. One such group is directed to copolymers which contain a carboxylate ester with one or more additional polar function, including amine, amide, imine, imide, hydroxy carboxyl, and the like. These products can be prepared by copolymerization of long chain alkyl acrylates or methacrylates with monomers of the above function. Such groups include alkyl methacrylate-vinyl pyrrolidinone copolymers, alkyl methacrylate-dialkylaminoethy methacrylate copolymers and the like. Additionally, high molecular weight amides and polyamides or esters and polyesters such as tetraethylene pentamine, polyvinyl polysterarates and other polystearamides may be employed. Preferred dispersants are N-substituted long chain alkenyl succinimides.

Mono and bis alkenyl succinimides are usually derived from the reaction of alkenyl succinic acid or anhydride and alkylene polyamines. These compounds are generally considered to have the formula

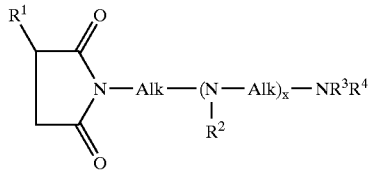

wherein $R^1$ is a substantially hydrocarbon radical having a molecular weight from about 450 to 3000, that is, $R^1$ is a hydrocarbyl radical, preferably an alkenyl radical, containing about 30 to about 200 carbon atoms; Alk is an alkylene radical of 2 to 10, preferably 2 to 6, carbon atoms, $R^2$, $R^3$, and $R^4$ are selected from a $C_1$–$C_4$ alkyl or alkoxy or hydrogen, preferably hydrogen, and x is an integer from 0 to 10, preferably 0 to 3. The actual reaction product of alkylene or alkenylene succinic acid or anhydride and alkylene polyamine will comprise the mixture of compounds including succinamic acids and succinimides. However, it is customary to designate this reaction product as a succinimide of the described formula, since this will be a principal component of the mixture. The mono alkenyl succinimide and bis alkenyl succinimide produced may depend on the charge mole ratio of polyamine to succinic groups and the particular polyamine used. Charge mole ratios of polyamine to succinic groups of about 1:1 may produce predominately mono alkenyl succinimide. Charge mole ratios of polyamine to succinic group of about 1:2 may produce predominately bis alkenyl succinimide.

These N-substituted alkenyl succinimides can be prepared by reacting maleic anhydride with an olefinic hydrocarbon followed by reacting the resulting alkenyl succinic anhydride with the alkylene polyamine. The $R^1$ radical of the above formula, that is, the alkenyl radical, is preferably derived from a polymer prepared from an olefin monomer containing from 2 to 5 carbon atoms. Thus, the alkenyl radical is obtained by polymerizing an olefin containing from 2 to 5 carbon atoms to form a hydrocarbon having a molecular weight ranging from about 450 to 3000. Such olefin monomers are exemplified by ethylene, propylene, 1-butene, 2-butene, isobutene, and mixtures thereof.

In a preferred aspect, the alkenyl succinimide may be prepared by reacting a polyalkylene succinic anhydride with an alkylene polyamine. The polyalkylene succinic anhydride is the reaction product of a polyalkylene (preferably polyisobutene) with maleic anhydride. One can use conventional polyisobutene, or high methylvinylidene polyisobutene in the preparation of such polyalkylene succinic anhydrides. One can use thermal, chlorination, free radical, acid catalyzed, or any other process in this preparation. Examples of suitable polyalkylene succinic anhydrides are thermal PIBSA (polyisobutenyl succinic anhydride) described in U.S. Pat. No. 3,361,673; chlorination PIBSA described in U.S. Pat. No. 3,172,892; a mixture of thermal and chlorination PIBSA described in U.S. Pat. No. 3,912,764; high succinic ratio PIBSA described in U.S. Pat. No. 4,234,435; PolyPIBSA described in U.S. Pat. Nos. 5,112,507 and 5,175,225; high succinic ratio PolyPIBSA described in U.S. Pat. Nos. 5,565,528 and 5,616,668; free radical PIBSA described in U.S. Pat. Nos. 5,286,799, 5,319,030, and 5,625,004; PIBSA made from high methylvinylidene polybutene described in U.S. Pat. Nos. 4,152,499, 5,137,978, and 5,137,980; high succinic ratio PIBSA made from high methylvinylidene polybutene described in European Patent Application Publication No. EP 355 895; terpolymer PIBSA described in U.S. Pat. No. 5,792,729; sulfonic acid PIBSA described in U.S. Pat. No. 5,777,025 and European Patent Application Publication No. EP 542 380; and purified PIBSA described in U.S. Pat. No. 5,523,417 and European Patent Application Publication No. EP 602 863. The disclosures of each of these documents are incorporated herein by reference in their entirety. The polyalkylene succinic anhydride is preferably a polyisobutenyl succinic anhydride. In one preferred embodiment, the polyalkylene succinic anhydride is a polyisobutenyl succinic anhydride having a number average molecular weight of at least 450, more preferably at least 900 to about 3000 and still more preferably from at least about 900 to about 2300.

In another preferred embodiment, a mixture of polyalkylene succinic anhydrides are employed. In this embodiment, the mixture preferably comprises a low molecular weight polyalkylene succinic anhydride component and a high molecular weight polyalkylene succinic anhydride component. More preferably, the low molecular weight component has a number average molecular weight of from about 450 to below 1000 and the high molecular weight component has a number average molecular weight of from 1000 to about 3000. Still more preferably, both the low and high molecular weight components are polyisobutenyl succinic anhydrides. Alternatively, various molecular weights polyalkylene succinic anhydride components can be combined as a dispersant as well as a mixture of the other above referenced dispersants as identified above.

The polyalkylene succinic anhydride can also be incorporated with the detergent which is anticipated to improve stability and compatibility of the detergent mixture. When employed with the detergent it can comprise from 0.5 to 5 percent by weight of the detergent mixture and preferably from about 1.5 to 4 weight percent.

The preferred polyalkylene amines used to prepare the succinimides are of the formula:

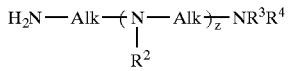

wherein z is an integer of from 0 to 10 and Alk, $R^2$, $R^3$, and $R^4$ are as defined above.

The alkylene amines include principally methylene amines, ethylene amines, butylene amines, propylene amines, pentylene amines, hexylene amines, heptylene amines, octylene amines, other polymethylene amines and also the cyclic and the higher homologs of such amines as piperazine and amino alkyl-substituted piperazines. They are exemplified specifically by ethylene diamine, triethylene tetraamine, propylene diamine, decamethyl diamine, octamethylene diamine, diheptamethylene triamine, tripropylene tetraamine, tetraethylene pentamine, trimethylene diamine, pentaethylene hexamine, ditrimethylene triamine, 2-heptyl-3-(2-aminopropyl)-imidazoline, 4-methyl imidazoline, N,N-dimethyl-1,3-propane diamine, 1,3-bis(2-aminoethyl) imidazoline, 1-(2-aminopropyl)-piperazine, 1,4-bis(2-aminoethyl)piperazine and 2-methyl-1-(2-aminobutyl) piperazine. Higher homologs such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk-Othmer, Vol. 5, pp. 898–905 (Interscience Publishers, New York, 1950). The term "ethylene amine" is used in a generic sense to denote a class of polyamines conforming for the most part to the structure $$H_2N(CH_2CH_2NH)_aH$$

wherein $\alpha$ is an integer from 1 to 10.

Thus, it includes, for example, ethylene diamine, diethylene triamine, triethylene tetraamine, tetraethylene pentamine, pentaethylene hexamine, and the like.

The individual alkenyl succinimides used in the alkenyl succinimide composition of the present invention can be prepared by conventional processes, such as disclosed in U.S. Pat. Nos. 2,992,708; 3,018,250; 3,018,291; 3,024,237; 3,100,673; 3,172,892; 3,202,678; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are all hereby incorporated by reference in their entirety for all purposes.

Also included within the term "alkenyl succinimides" are post-treated succinimides such as post-treatment processes involving borate or ethylene carbonate disclosed by Wollenberg, et al., U.S. Pat. No. 4,612,132; Wollenberg, et al., U.S. Pat. No. 4,746,446; and the like as well as other post-treatment processes each of which are incorporated herein by reference in its entirety. Preferably, the carbonate-treated alkenyl succinimide is a polybutene succinimide derived from polybutenes having a molecular weight of 450 to 3000, preferably from 900 to 2500, more preferably from 1300 to 2300, and preferably from 2000 to 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as taught in U.S. Pat. No. 5,716,912 incorporated herein by reference.

Preferably, the alkenyl succinimide component comprises from 1 to 20 weight percent, preferably 2 to 12 weight percent, and more preferably 4 to 8 weight percent of the weight of the lubricant composition.

Lubricating Oil and Lubricating Compositions

The lubricating oil compositions of the present invention can be conveniently prepared by simply blending or mixing of high TBN sulfonate detergent and the dispersant, with an oil of lubricating viscosity (base oil). The compounds of the invention may also be preblended as a concentrate or package with various other additives in the appropriate ratios to facilitate blending of a lubricating composition containing the desired concentration of additives. The compounds of the present invention are blended with base oil a concentration at which they provide improved fuel economy and are both soluble in the oil and compatible with other additives in the desired finished lubricating oil. Compatibility in this instance generally means that the present compounds as well as being oil soluble in the applicable treat rate also do not cause other additives to precipitate under normal conditions. Suitable oil solubility/compatibility ranges for a given compound of lubricating oil formulation can be determined by those having ordinary skill in the art using routine solubility testing procedures. For example, precipitation from a formulated lubricating oil composition at ambient conditions (about 20° C.–25° C.) can be measured by either actual precipitation from the oil composition or the formulation of a "cloudy" solution which evidences formation of insoluble wax particles.

The lubricating oil, or base oil, used in the lubricating oil compositions of the present invention are generally tailored to the specific use e.g. engine oil, gear oil, industrial oil, cutting oil, etc. For example, where desired as a crankcase engine oil, the base oil typically will be a mineral oil or synthetic oil of viscosity suitable for use in the crankcase of an internal combustion engine such as gasoline engines and diesel engines which include marine engines. Crankcase lubricating oils ordinarily have a viscosity of about 1300 cSt at 0° F. to 24 cSt at 210° F. (99° C.) the lubricating oils may be derived from synthetic or natural sources. Natural oils include animal oils and vegetable oils (e.g. castor oil, lard oil) as well as mineral oil. Mineral oil for use as the base oil in this invention includes paraffinic, naphthenic and other oils that are ordinarily used in lubricating oil compositions, including solvent treated, hydro treated or oils from Fisher-Tropsch processes. Preferred oils of lubricating viscosity used in this invention should have a viscosity index of at least 95, preferably at least 100. The preferred are selected from API Category oils Group I through Group IV and preferably from Group II, III and IV or mixtures thereof optionally blended with Group I. Synthetic oils include both hydrocarbon synthetic oils and synthetic esters. Useful synthetic hydrocarbon oils include liquid polymers of alpha olefins having the proper viscosity. Especially useful are the hydrogenerated liquid oligomers of $C_6$ to $C_{12}$ alpha olefins such as 1-decene trimer. Likewise, alkyl benzenes of proper viscosity such as didodecyl benzene can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used. Blends of various mineral oils, synthetic oils and minerals and synthetic oils may also be advantageous, for example to provide a given viscosity or viscosity range. In general the base oils or base oil mixtures for engine oil are preselected so that the final lubricating oil, containing the various additives, including the present fuel economy additive composition, has a viscosity at 100° C. of 4 to 22 centistokes, preferably 10 to 17 centistokes and more preferably 13 to 17 centistokes.

Typically the lubricating oil composition will contain a variety of compatible additives desired to impart various properties to the finished lubricating oil composition depending on the particular end use and base oils used. Such additives include supplemental neutral and basic detergents such as natural and overbased organic sulfonates and normal and overbased phenates and salicylates, dispersants, and/or ashless dispersants. Also other additives such as antiwear agents, friction modifiers, rust inhibitors, foam inhibitors, pour point dispersants, antioxidants, including the so called viscosity index (VI) improvers, dispersant VI improvers and, as noted above, other corrosion or wear inhibitors.

Preferably a minor amount of antiwear agent, a metal dihydrocarbyl dithiophosphate is added to the lubricant composition. The metal is preferably zinc. The dihydrocarbyldithiophosphate may be present in amount of 0.1 to 2.0 mass percent but typically low phosphorous compositions are desired so the dihydrocarbyldithiophosphate is employed at 0.25 to 1.2, preferably 0.5 to 0.7, mass %, in the lubricating oil composition. Preferably, zinc dialkylthiophosphate (ZDDP) is used. This provides antioxidant and antiwear properties to the lubricating composition. Such compounds may be prepared in accordance with known techniques by first forming a dithiophosphoric acid, usually by reaction of an alcohol or a phenol with $P_2S_5$ and then neutralizing the dithiophosphoric acid with a suitable zinc compound. Mixtures of alcohols may be used including mixtures of primary and secondary alcohols. Examples of such alcohols include, but are not restricted to the following list: iso-propanol, iso-octanol, 2-butanol, methyl isobutyl carbinol (4-methyl-1-pentane-2-ol), 1-pentanol, 2-methyl butanol, and 2-methyl-1-propanol. The hydrocarbyl groups can be a primary, secondary, or mixtures thereof, e.g. the compounds may contains primary and/or secondary alkyl groups derived from primary or secondary carbon atoms. Moreover, when employed, there is preferably at least 50, more preferably 75 or more, most preferably 85 to 100, mass % secondary alkyl groups; an example is a ZDDP having 85 mass % secondary alkyl groups and 15 mass % primary alkyl groups, such as a ZDDP made from 85 mass % butan-2-ol and 15 mass % iso-octanol. Even more preferred is a ZDDP derived from derived from sec-butanol and methylisobutylcarbinol and most preferably wherein the sec-butanol is 75 mole percent.

The metal dihydrocarbyldithiophosphate provides most if not all, of the phosphorus content of the lubricating oil composition. Amounts are present in the lubricating oil composition to provide a phosphorus content, expressed as mass % elemental phosphorus, of 0.10 or less, preferably 0.08 or less, and more preferably 0.075 or less, such as in the range of 0.025 to 0.07.

Oxidation inhibitors or antioxidants reduce the tendency of base stocks to deteriorate in service, which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, alkyl-substituted diphenylamine, alkyl-substituted phenyl and naphthylamines, phosphorus esters, metal thiocarbamates, ashless thiocarbamates (preferred are dithiocarbamates are methylenebis(dibutyldithiocarbamate), ethylenebis (dibutyldithiocarbamate), and isobutyl disulfide-2,2'-bis(dibutyldithiocarbamate). Preferred phenol type oxidation inhibitors are selected from the group consisting of: 4,4'-methylene bis(2,6-di-tert-butylphenol), 4,4'-bis(2,6-di-tert-butylphenol), 4,4'-bis(2-methyl-6-tert-butylphenol), 2,2'-methylene bis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methyl-phenol, 2,6-di-tert-butyl-4-ethylphenol, 2,4-dimethyl-6-tert-butylphenol, 2,6-di-tert-4-(N,N'dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine type oxidation inhibitor: alkylated diphenylamine, phenyl.-alpha.-naphthylamine, and alkylated alpha-naphthylamine.

In some lubricating oil formulations the amount of fuel efficiency of the lubricant composition comprising a high TBN sulfonate detergent and succinimide dispersant as lower than desired, in such instance friction modifiers may be employed. Various methods can be used to measure fuel economy of the resulting lubricating composition. In one preferred aspect the Sequence VIB test is employed and measured at different speed/load/temperature conditions and compared to a baseline oil. Such a test is specified for ILSAC GF-3 and Energy Conserving associated with SL. Preferably the lubricating composition exceeds the minimum rating by at least 10% and more preferably by at least 20%. To achieve these large improvements in some instances a friction modifier is needed.

Such friction modifier is preferably an oil soluble organic friction modifier incorporated in the lubricating oil composition in an amount of from about 0.02 to 2.0 wt. % of the lubricating oil composition. Preferably, from 0.05 to 1.0, more preferably from 0.1 to 0.5 wt. % of the friction modifier is used.

Friction modifiers include such compounds as aliphatic amines or ethoxylated aliphatic amines, aliphatic fatty acid amides, aliphatic carboxylic acids, aliphatic carboxylic esters of polyols such as glycerol esters of fatty acid as exemplified by glycerol oleate, boric esters of glycerol fatty acid monoesters, aliphatic carboxylic ester-amides, aliphatic phosphonates, aliphatic phosphates, aliphatic thiophosphonates, aliphatic thiophosphates, etc., wherein the aliphatic group usually contains above about eight carbon atoms so as to render the compound suitably oil soluble.

Representative examples of suitable friction modifiers are found in U.S. Pat. No. 3,933,659 which discloses fatty acid esters and amides; U.S. Pat. No. 4,105,571 which discloses glycerol esters of dimerized fatty acids; U.S. Pat. No. 4,702,859 which discloses esters of carboxyclic acids and anhydrides with alkanols; U.S. Pat. No. 4,530,771 which is a preferred borated glycerol monooleate comprising esters constituted with a glycerol, fatty acid and a boric acid, said ester having a positive amount up to 2.0 moles of a carboxylic acid residue comprising a saturated or unsaturated alkyl group having 8 to 24 carbon atoms and 1.5 to 2.0 moles of a glycerol residue, both per unit mole of a boric acid residue on average of the boric esters used singly or in combination, molar proportion between said carboxylic acid residue and said glycerol residue being that the glycerol residue is 1.2 moles or more based on 1 mole of the carboxylic acid residue; U.S. Pat. No. 3,779,928 which discloses alkane phosphonic acid salts; U.S. Pat. No. 3,778,375 which discloses reaction products of a phosphonate with an oleamide; and U.S. Pat. No. 3,932,290 which discloses reaction products of di-(lower alkyl) phosphites and epoxides. The disclosures of the above references are herein incorporated by reference. Examples of nitrogen containing friction modifiers, include, but are not limited to, imidazolines, amides, amines, alkoxylated amines, alkoxylated ether amines, amine oxides, amidoamines, nitriles, betaines, quaternary amines, imines, amine salts, amino guanadine, alkanolamides, and the like. Such friction modifiers can contain hydrocarbyl groups that can be selected from straight chain, branched chain or aromatic hydrocarbyl groups or admixtures thereof, and may be saturated or unsaturated. Hydrocarbyl groups are predominantly composed of carbon and hydrogen but may contain one or more hetero atoms such as sulfur or oxygen. Preferred hydrocarbyl groups range from 12 to 25 carbon atoms and may be saturated or unsaturated. More preferred are those with linear hydrocarbyl groups.

The lubricating composition of the present invention may also contain a viscosity index improver or VII. Viscosity Index Improver. Examples of the viscosity index improvers are poly-(alkyl methacrylate), ethylene-propylene copolymer, styrene-butadiene copolymer, and polyisoprene. Viscosity index improvers of dispersant type (having increased dispersancy) or multifunction type are also employed. These viscosity index improvers can be used singly or in combination. The amount of viscosity index improver to be incorporated into an engine oil varies with desired viscosity of the compounded engine oil, and generally in the range of 0.5–20 wt. % per total amount of the engine oil.

The present invention also provides an additive package or concentrate, which may be added to an oil of lubricating viscosity either as the sole additive or in combination with other additives. (Generally, the additive package will not contain a viscosity index improver because even where desired the viscosity index improver is generally added to the base oil by the lubricant formulator.) Thus, a preferred additive concentrate contains about from 10 to 75 wt. %, preferably 10 to 60 wt %, and more preferably 35 to 60 wt. % of the alkenyl succinimide employed in the present invention and sufficient basic material of the overbased detergent, namely the 450 to 550 TBN alkyl aryl sulfonate detergent, to provide the concentrate with a TBN of about from 60 to 180 preferably 60 to 120; and about 1 to 10 wt. % preferably 2 to 6 wt. % of a diluent oil or other compatible inert organic liquid diluent. With the general exception of the VI improver, the concentrate will frequently also contain various other additives considered desirable from the intended use and generally frequently will also contain neutral or slightly alkaline detergent in addition to the overbased detergent. The amount of overbased detergent needed to provide the requisite TBN will, of course, vary with the TBN of the overbased detergent but typically will be 10 to 80 wt. % of the concentrate. The concentrate may also be provided as an individual concentrate containing about from 85 to 95 wt. % of the alkenyl succinimide and a 450 to 550 TBN alkyl aryl sulfonate detergent mixture and about 5 to 15 wt. % of an inert organic liquid diluent designed for formulation either into an additives package or directly into the base oil. Additive packages or concentrates may also be provided for greases, though generally such packages will contain little more than the compounds of the present invention and perhaps other antiwear or extreme pressure agents.

EXAMPLES

The invention is further illustrated by the following examples which are not to be considered as limitative of its scope.

The basestock formulation employed a formulated oil employing a lubricating oil and additives in their typical amounts for particular purpose; this included a Group II base oil of a viscosity grade of 5W20; 3.0 wt % of a bissuccinimide dispersant post treated with ethylene carbonate, wherein the molecular weight of alkenyl group was derived from a 2300 molecular weight polyisobutylene and the alkylene polyamine was heavy polyamine (containing an average of approximately 6.5 nitrogen atoms per molecule and a Mn of from 250 to 340, suitable heavy polyamines are commercially available from Union Carbide as HPA-X) which was then post treated with ethylene carbonate at a ration of approximately 2 mole of ethylene carbonate to 1 mole of basic nitrogen of the succinimide; 0.6 wt % of a secondary alcohol ZnDTP (derived from sec-butanol and methylisobutylcarbinol); 0.5 wt % of an alkyl diphenyl amine; 0.5 wt % of a borated glycerol mono-oleate as disclosed in U.S. Pat. No. 5,629,272; and a viscosity index improver, pour point depressant and an antifoam agent. To this basestock different ash detergents were added a concentration of 55.0 millimole/kilogram and subjected to engine testing, the results are presented below and graphically as FIG. 1.

Detergent 1: High Overbased 500 TBN calcium alkyl aryl sulfonate prepared in accordance with Example A-1, Detergent B: A high overbased 426 TBN calcium alkyl aryl sulfonate derived from benzene and $C_{20}$–$C_{24}$ normal alpha olefins under similar conditions as Example A. The detergent is characterized by having a total calcium wt % of approximately 16.0 and a kinematic viscosity at 100° C. of 110 cSt.

Detergent C: is a 250 TBN alkyl phenate characterized by having at total calcium wt % of 9.25 and a kinematic viscosity at 100° C. of 230 cSt. Such alkyl phenates can be prepared according to U.S. Pat. No. 3,178,368.

Detergent D is a 170 TBN calcium salicylate characterized by having a total calcium wt % of 6.0.

Example 1

55.0 millimole/kilogram of a 500 TBN calcium alkyl aryl sulfonate detergent (Detergent 1) was blended into the baseline formulation (depicted above) and is representative of a fully formulated passenger car crankcase engine oil. The fuel economy performance was determined by engine testing using a shortened version of the Sequence VIB test entitled herein as the Sequence VIB screener. The Sequence VIB (ASTM D6837) is an engine dynamometer test that measures a lubricant's ability to improve the fuel economy of passenger cars and light-duty trucks equipped with a low friction engine. The method compares the performance of a test lubricant to the performance of a baseline lubricant over five different stages of operation. The standard Sequence VIB test incorporates a flush and run type procedure with each test consisting of two 5-stage fuel economy measurements on a baseline oil (BC), one at the beginning of the test (Phase I) and one at the end (Phase II). The test oil is evaluated in between the two baseline runs. After the test oil is initially aged during 16 hours of engine operation at 1500 r/min and 125° C. oil temperature, a phase one fuel economy for the candidate test oil is calculated. Following 80 hours at an engine speed of 2250 r/min and 135° C. oil temperature. The test oil once again goes through a 5-stage fuel economy measurement. A phase one and phase two fuels economy improvement of the candidate oil compared to the baseline oil fuel economy is calculated. In the shortened Sequence VIB screener only Phase I fuel economy is determined without severity adjustment. The calculated fuel economy improvement equates the fuel economy results obtained from vehicles representative of current production vehicles running under the current EPA (Environmental Protection Agency) testing cycles. Passing criteria, as used herein, relates to the minimum % fuel economy improvement versus the ASTM baseline (reference oil BC) for SAE 0W-20 and 5W-20 viscosity grades is at least 2.4% minimum after Phase I (16 hours aging), 2.0% minimum for SAE 0W-30 and 5W30 viscosity grades and at least 1.3% for all other SAE multiviscosity grades. In the present instance the lubricating oil composition of Example 1 provided a passing result at 2.65% fuel economy improvement.

Example 2 was a repeat test of Example 1, which resulted in a passing result at 2.46% fuel economy improvement.

Comparative Example 3 employed 55.0 millimole/kilogram a 426 TBN calcium alkyl aryl sulfonate described as Detergent B, which resulted in a failing result at 2.29% fuel economy improvement.

Comparative Examples 4–6 employed 55.0 millimole/kilogram of a 250 TBN alkyl phenate described as Detergent C which all resulted in failing results at 2.22, 2.18 and 1.83% fuel economy improvement.

Comparative Example 7 employed 55.0 millimole/kilogram of a 170 TBN salicylate described as Detergent D which resulted in a failing result at 1.58% fuel economy improvement.

What is claimed is:

1. A lubricating composition comprising:

a major amount of an oil of lubricating viscosity, an oil soluble overbased alkaline earth alkyl aryl sulfonate detergent having a total base number (TBN) of about 450 to 550 and a kinematic viscosity at 100° C. of less than 500 cSt, and an alkenyl succinimide dispersant derived from a 450 to 3000 average molecular weight polyalkylene.

2. The lubricating composition of claim 1 wherein the TBN is greater than 475.

3. The lubricating composition of claim 2 wherein the TBN is 480 to 500.

4. The lubricating composition of claim 1 wherein the alkaline earth metal is calcium.

5. The lubricating composition of claim 4 wherein the sulfonate detergent is derived from a $C_{14-40}$ carbon linear normal alpha olefin wherein at least 13 mole percent of the alkyl group is attached at the 1 or 2 position of the alkyl group to the aryl group.

6. The lubricating composition of claim 1 wherein the polyalkylene group is polyisobutenyl having an average molecular weight of 900 to 2300.

7. The lubrication composition of claim 6 wherein the polyisobutenyl succinimide is post treated with ethylene carbonate.

8. The lubricating composition of claim 1 further comprising a friction modifier.

9. The lubricating composition of claim 8 wherein the friction modifier is a borated glycerol monooleate ester.

10. The lubricating composition of claim 1 further comprising a phosphorous component.

11. The lubricating composition of claim 10 wherein the phosphorous component is dialkyl dithiophosphate and wherein the total phosphorous content of the composition is 0.10 or less mass % elemental phosphorous.

12. A lubricating oil composition for internal combustion engines which comprises:

(a) a major amount of a base oil of lubricating viscosity;

(b) 0.5% to 10% of an overbased calcium alkyl aryl sulfonate detergent having a total base number (TBN) of about 450 to 550 and a kinematic viscosity at 100° C. of less than 500 cSt;

(c) 1% to 20% of a carbonate treated alkenyl succinimide dispersant derived from a 450 to 3000 average molecular weight polyalkylene;

(d) 0.05% to 1.0% of a friction modifier, and (e) 0.25% to 1.2% of a zinc dialkyldithiophosphate; wherein the percent additive is based upon weight percent of the lubricating oil composition.

13. A concentrate comprising from about 10% to 80% of an overbased calcium alkyl aryl sulfonate detergent having a total base number (TBN) of about 450 to 550 and a kinematic viscosity at 100° C. of less than 500 cSt: and from about 10% to 60% of an ailcenyl succinimide dispersant derived from a 450 to 3000 average molecular weight polyalkylene and about 1% to 10% of a compatible organic liquid diluent.

14. A method for improving fuel economy of a gasoline internal combustion engine comprising operating said engine with a lubricating composition comprising a major amount of an oil of lubricating viscosity; a fuel economizing amount of an oil soluble an alkaline earth alkyl aryl sulfonate detergent having a TBN greater than 450 and a kinematic viscosity at 100° C. of less than 500 cSt; and an alkenyl succinimide dispersant derived from a 450 to 3000 average molecular weight polyalkylene.

15. The method according to claim 14 wherein the detergent has a TBN of 460 to 550.

16. The method according to claim 15 wherein the TBN is from 475 to 500.

17. The method according to claim 14 wherein the alkaline earth metal is calcium.

18. The method according to claim 14 wherein the sulfonate detergent is derived from a $C_{14-40}$ carbon linear normal alpha olefin wherein at least 13 mole percent of the alkyl group is attached at the 1 or 2 position of the alkyl group to the aryl group.

19. The method according to claim 14 wherein the polyalkylene group is polyisobutenyl having an average molecular weight of 900 to 2300.

20. The method according to claim 14 wherein the polyisobutenyl succinimide is post treated with ethylene carbonate.

21. The method according to claim 14 further comprising a friction modifier.

22. The method according to claim 21 wherein the friction modifier is a borated glycerol monooleate ester.

23. The method according to claim 14 further comprising a phosphorous component.

24. The method according to claim 23 wherein the phosphorous component is dialkyl dithiophosphate and wherein the total phosphorous content of the composition 0.10 or less mass % elemental phosphorous.

25. The lubricating composition of claim 1 wherein the sulfonate detergent has a kinematic viscosity at 100° C. of less than 350 cSt.

26. The lubricating composition of claim 25 wherein the sulfonate detergent has a kinematic viscosity at 100° C. of less than 250 cSt.

27. The lubricating composition of claim 25 wherein the sulfonate detergent has a kinematic viscosity at 100° C. of less than 200 cSt.

* * * * *